US005415210A

United States Patent [19]

Hannah

[11] Patent Number: 5,415,210

[45] Date of Patent: May 16, 1995

[54] FUNNEL FOR ATTACHMENT TO ONE END OF A CYLINDRICAL DRUM

[76] Inventor: Garnet Hannah, 2751 Silverman Bay, Regina, Saskatchewan, Canada, S4V 1X5

[21] Appl. No.: 181,218

[22] Filed: Jan. 13, 1994

[51] Int. Cl.[6] ..... B67C 11/00

[52] U.S. Cl. ..... 141/333; 141/86; 141/98; 141/332

[58] Field of Search ..... 141/98, 331–333, 141/339–342, 363–366, 86; 220/571, 571.1, 573; 184/106

[56] References Cited

U.S. PATENT DOCUMENTS

| | | | |
|---|---|---|---|
| 418,738 | 1/1890 | Moull | 141/332 |
| 578,671 | 3/1897 | Wisdom | 141/332 X |
| 4,802,599 | 2/1989 | Hill | 141/331 X |
| 4,874,023 | 10/1989 | Ulm | 141/364 X |
| 5,033,520 | 7/1991 | Kuemichel | 141/333 X |
| 5,117,878 | 6/1992 | Shaw et al. | 141/333 |
| 5,121,778 | 6/1992 | Baker et al. | 141/363 X |
| 5,143,178 | 9/1992 | Latham, Jr. | 184/106 |
| 5,172,739 | 12/1992 | Ristroph | 141/98 |
| 5,291,921 | 3/1994 | Devine | 141/332 X |

FOREIGN PATENT DOCUMENTS

| | | | |
|---|---|---|---|
| 9002413 | 6/1991 | Netherlands | 141/333 |

OTHER PUBLICATIONS

Brochure—entitled "Poly-Funnel System" comprising 2 pages undated.

*Primary Examiner*—J. Casimer Jacyna

*Attorney, Agent, or Firm*—Adrian D. Battison; Murray E. Thrift; Stanley G. Ade

[57] ABSTRACT

A funnel is designed for attachment to one end of a cylindrical drum and includes an inclined funnel surface depending toward a discharge opening passing through an opening adjacent one edge of the drum. Around the inclined surface is a raised flange and outside the flange is a depending skirt. The skirt is attached to the peripheral wall of the drum by screw fasteners. The flange includes a plurality of recesses with each recess defining a horizontal bottom wall which sits on the end of the drum. A lid is also provided for engagement onto the funnel and comprises a dome central section and a peripheral depending section for engaging over the outer surface of the flange of the funnel. The peripheral section includes a plurality of recesses corresponding to the recesses of the flange to act as a friction fit within the recesses to hold the lid in place.

12 Claims, 4 Drawing Sheets

FUNNEL FOR ATTACHMENT TO ONE END OF A CYLINDRICAL DRUM

BACKGROUND OF THE INVENTION

This invention relates to a funnel for mounting on an end of a cylindrical drum for directing fluids into an opening at the end of the drum.

In the current increased climate for environmental concerns, the collection of used fluids such as oil, paint, industrial cutting fluids, farm chemicals and the like is more important. Often these fluids are generated in relatively small amounts and collected in relatively small containers and therefore it is necessary to transfer the fluids to a larger container for collection and longer term storage. It is desirable therefore to provide a funnel arrangement which can be mounted on the end of a cylindrical drum so that the used liquids can be readily poured from a smaller container into the larger cylindrical drum.

One example of an arrangement of this type is known as the "Poly-Funnel" system (Trademark) manufactured by ENPAC of Jacksonville, Fla. This device comprises a generally dish shaped element with an upper funnel surface surrounded by a raised rib. The funnel surface converges downwardly toward to a discharge opening adjacent the peripheral rib for directing the material into the conventional opening of the 30 or 55 gallon drum for which the device is designed. The device includes a plurality of channels which converge toward the opening and these channels allow a filter or the like to sit on the surface while the liquid drains from the filter into the channels and down to the discharge openings.

The device is generally satisfactory but there is of course an ongoing requirement to provide yet further improvements.

SUMMARY OF THE INVENTION

According to one object of the invention there is provided an improved funnel for attachment to a drum which has an improved attachment system enabling the funnel to remain permanently attached to the drum for extended periods of time.

It is a further object of the present invention to provide a funnel which includes an improved lid construction allowing the device to be stored outside without collecting rain water or other materials.

According to a first aspect of the invention there is provided a funnel for mounting on an end of a cylindrical drum for directing fluids into an opening at the end of the drum comprising a molded funnel body defining an upper funnel surface, an annular raised flange portion surrounding the upper funnel surface, an annular skirt depending downwardly from the raised flange portion, the funnel surface being inclined toward a drain opening adjacent the raised flange portion at one side of the funnel surface, and engagement wall means for engaging a horizontal surface at the end of the drum for supporting the funnel body on the end of the drum against downward movement, the skirt depending downwardly of the engagement wall means for surrounding a cylindrical wall surface of the end of the drum and including fastener means for extending inwardly of the skirt to engage the drum at the cylindrical wall surface whereby the skirt, the fastener means and the engagement wall means hold the funnel body fastened to the end of the drum.

According to a second aspect of the invention there is provided a funnel for mounting on an end of a cylindrical drum for directing fluids into an opening at the end of the drum comprising a molded funnel body defining an upper funnel surface, an annular raised flange portion surrounding the upper funnel surface, an annular skirt depending downwardly from the raised flange portion, the funnel surface being inclined toward a drain opening adjacent the raised flange portion at one side of the funnel surface, and engagement wall means for engaging a horizontal surface at the end of the drum for supporting the funnel body on the end of the drum against downward movement, wherein the engagement wall means comprises a plurality of separate substantially horizontal wall portions arranged at spaced positions around the funnel surface and extending inwardly from the skirt.

According to a third aspect of the invention there is provided a funnel for mounting on an end of a cylindrical drum for directing fluids into an opening at the end of the drum comprising a molded funnel body defining an upper funnel surface, an annular raised flange portion surrounding the upper funnel surface, an annular skirt depending downwardly from the raised flange portion, the funnel surface being inclined toward a drain opening adjacent the raised flange portion at one side of the funnel surface, and engagement wall means for engaging a horizontal surface at the end of the drum for supporting the funnel body on the end of the drum against downward movement, and a domed lid having a peripheral engagement portion for engaging the raised flange portion of the funnel body and a central domed portion extending upwardly from the peripheral engagement portion and covering the funnel surface leaving a space therebetween for a body to be drained.

The funnel or drain tray of the present invention provides a convenient and efficient method for transfer of used oil or other liquids into a 45 gallon or 205 liter drum. The drain tray can adapt to all metal and plastic 45 gallon barrels. Oil filters can be left to drain by placing them upside down on the risers or ribs of the drain tray. Any one who generates 25 gallons or more of used oil annually will find this product valuable in helping them to safely handle and transport used oil and other liquids. The device makes it simple to handle waste liquids from the drain plug to the recycling depot.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 2:
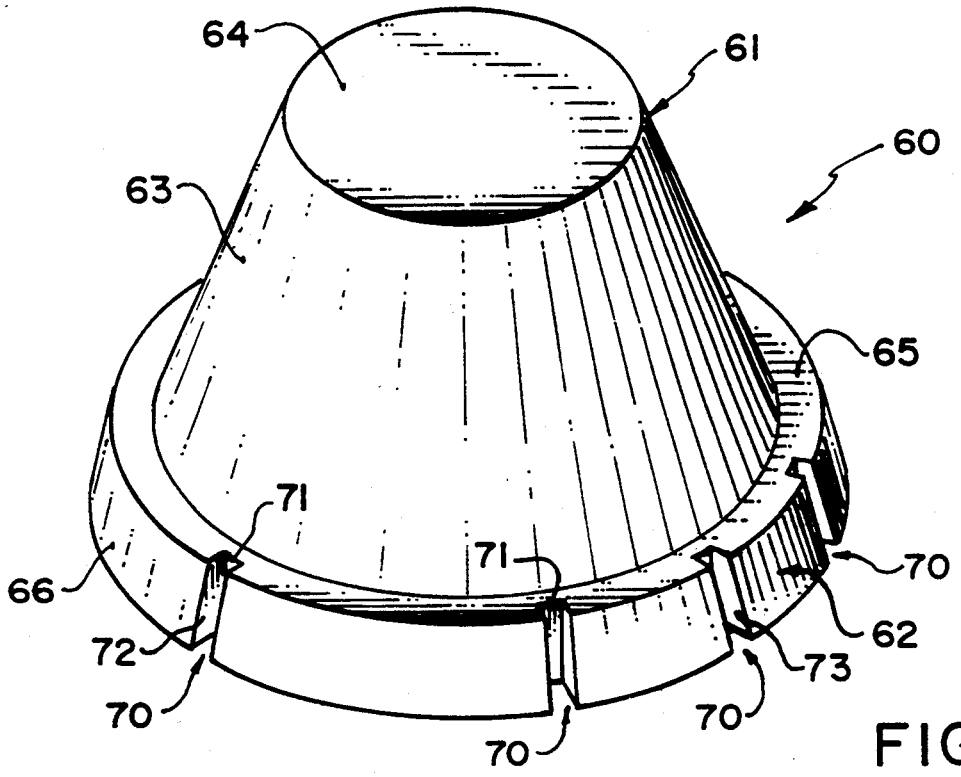
FIG. 2 is an isometric view of a lid for mounting on the funnel of FIG. 1.
Figure 1:
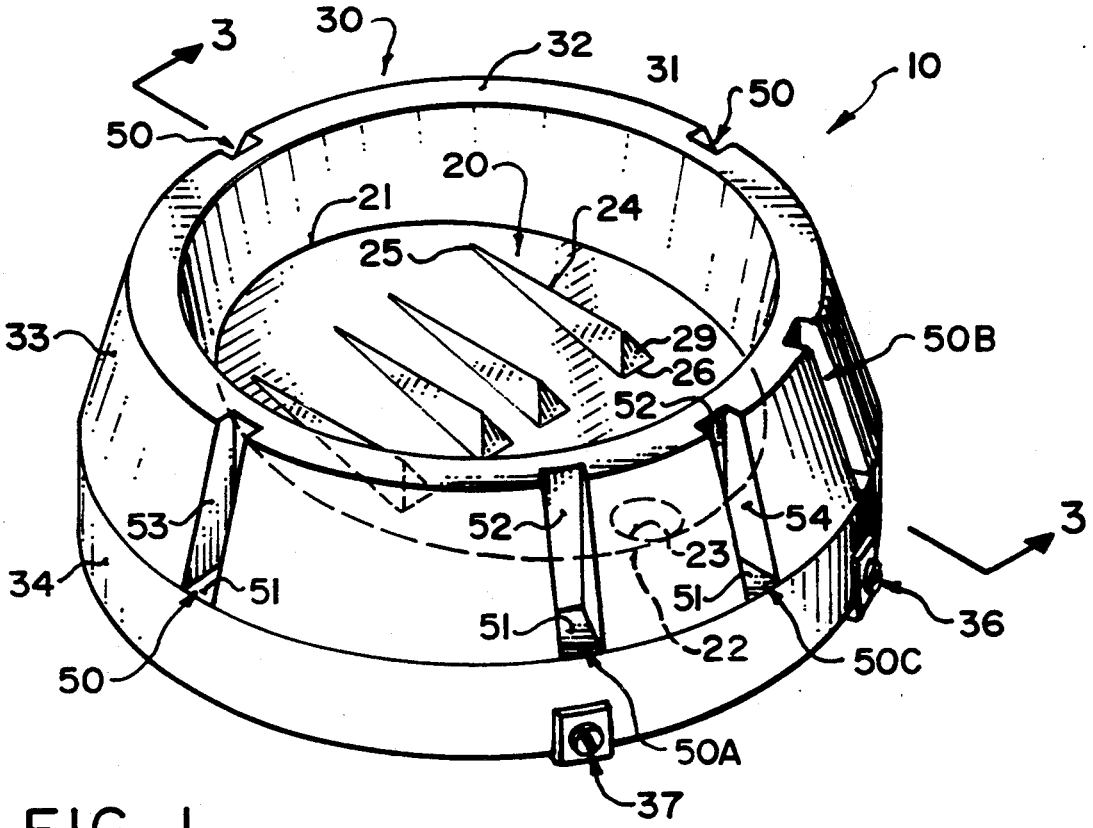
FIG. 1 is an isometric view of the funnel according to the present invention
Figure 3:
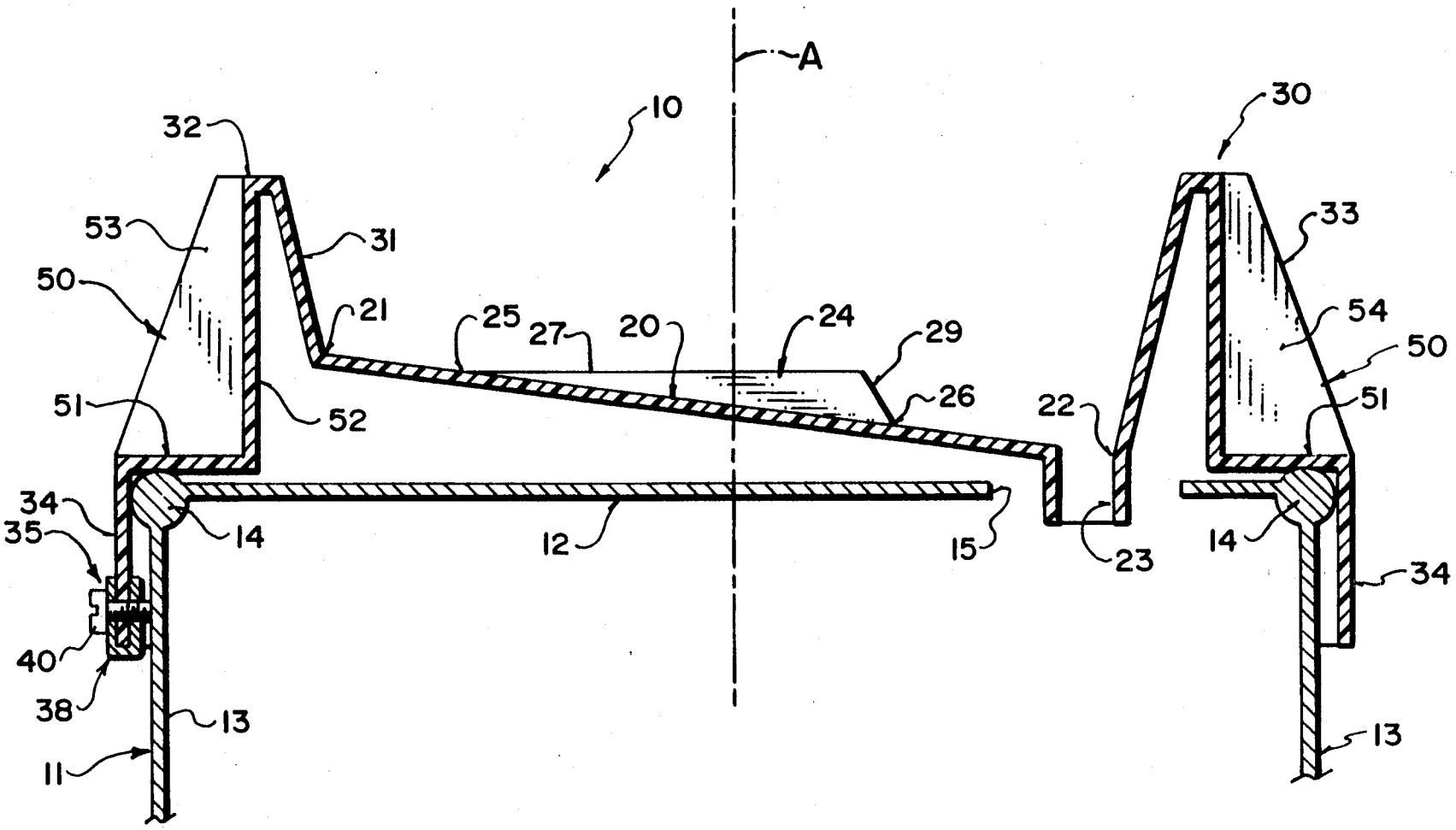
FIG. 3 is a cross sectional view along the lines 3—3 of FIG. 1.
Figure 4:
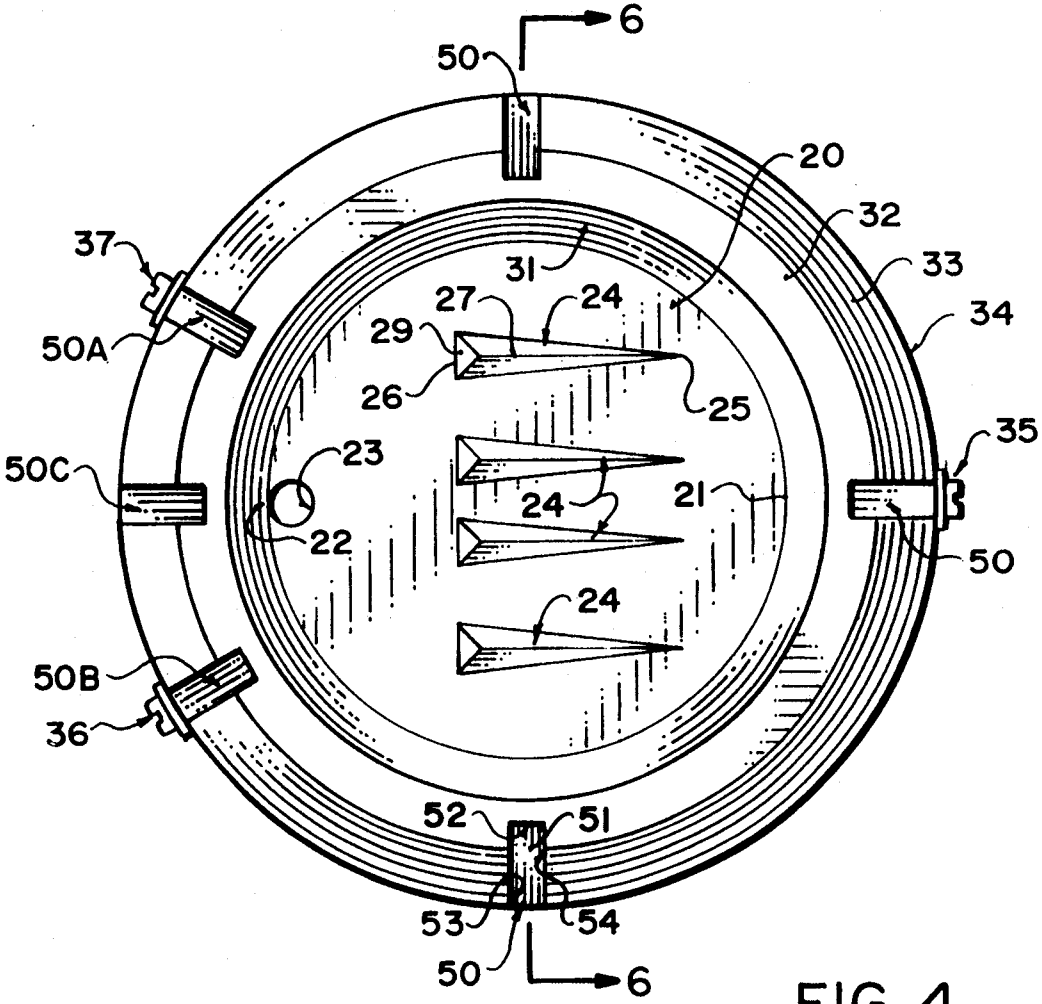
FIG. 4 is a top plan view of the funnel of FIG. 1.
Figure 5:
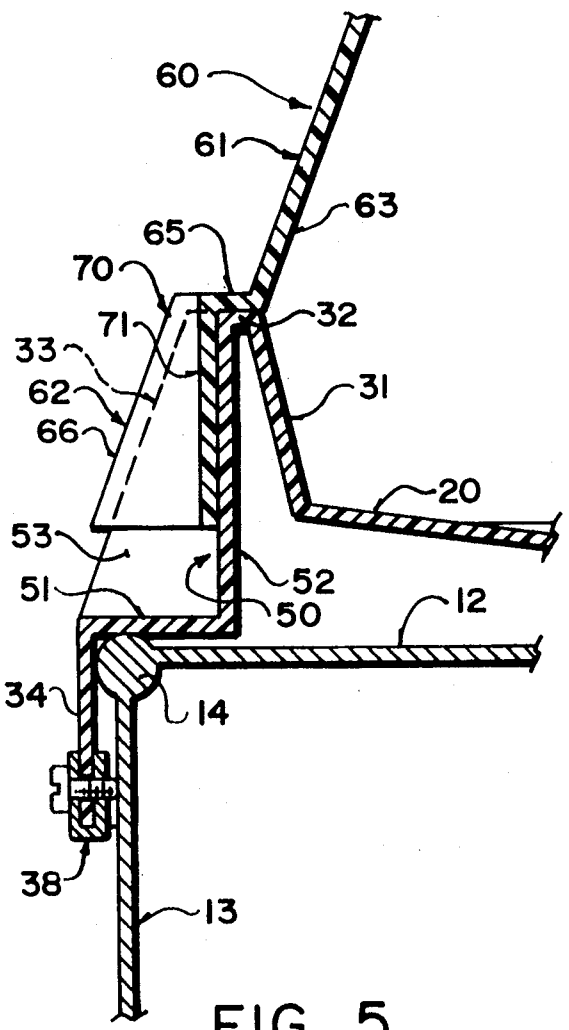
FIG. 5 is a cross sectional view similar to that of FIG. 3 showing one part only of the funnel with the lid mounted thereon.

The funnel is indicated generally at 10 and is arranged for mounting upon a drum 11 of the type including a circular end wall 12 and a cylindrical peripheral wall 13. Drums of this type often include a bead 14 surrounding the end wall 12. The end wall 12 includes an opening 15 adjacent the bead at one point of the periphery and that opening 15 is generally closed by a bung which is screw threaded into the opening.

The funnel 10 comprises an upper funnel surface 20 which is generally circular in plan view and generally flat but inclined to the horizontal so that the surface extends downwardly from a raised end 21 to a lower end 22 at which a discharge spout 23 is located for discharging liquids running across the funnel surface into the opening 15. The spout 23 extends slightly downwardly engaging the opening 15 to ensure that the liquids properly enter the opening 15.

Figure 6:
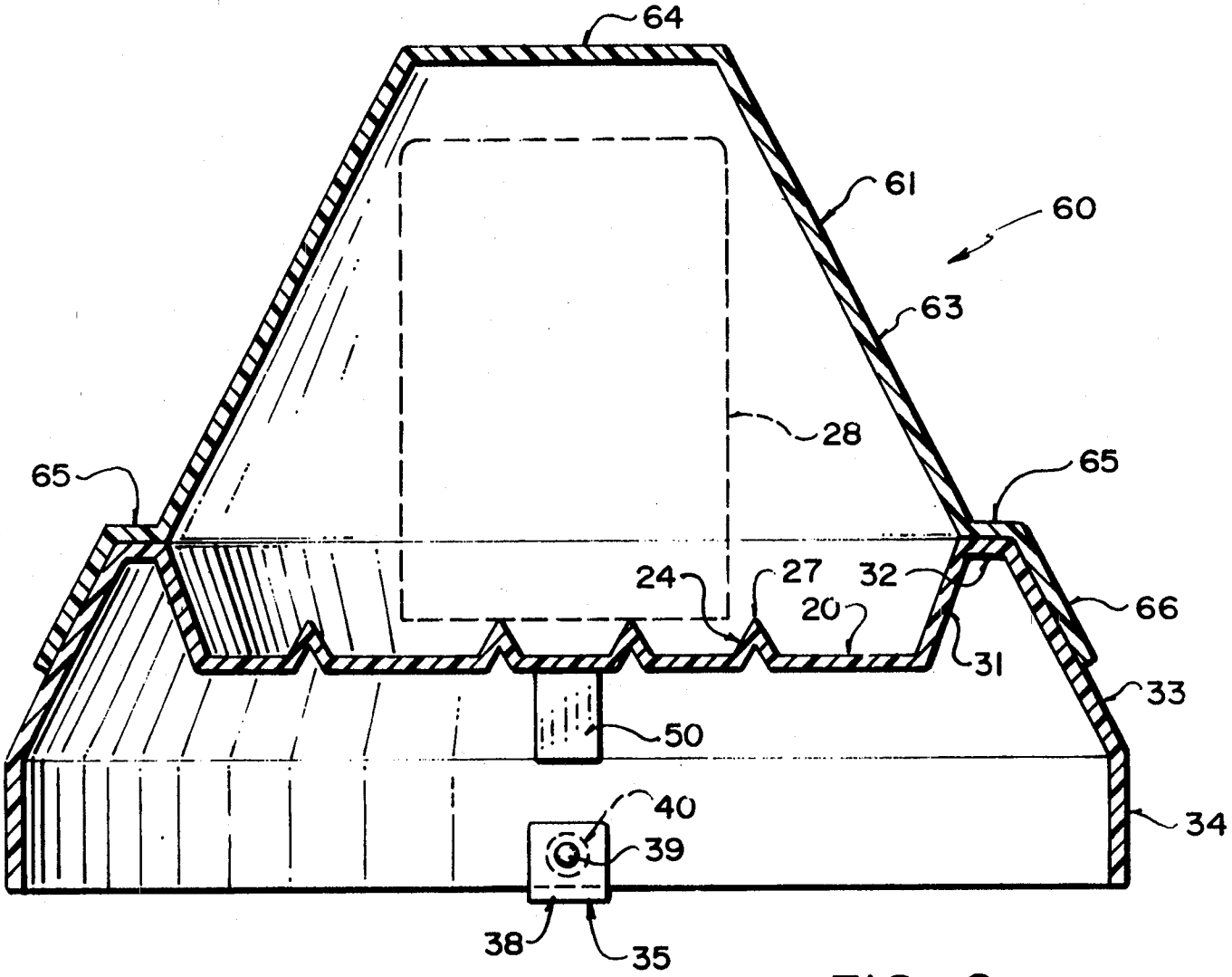
FIG. 6 is a cross sectional view taken along the lines 6—6 of FIG. 4 showing the lid also in place.

On the funnel surface is provided four ribs 24 which lie parallel and extend from an upper end 25 spaced partly across the surface 20 to a lower end 26 again spaced partly across the surface 20 toward the opening 23. The ribs 24 are triangular in cross section as best shown in FIG. 6 so as to define an uppermost apex 27 on which a body 28 can stand for draining. The apex 27 of the rib is generally horizontal so that its distance from the surface gradually increases from the end 25 at which it merges into the surface to the end 26 which is spaced from the surface and defines a triangular end face 28. The ribs are spaced apart across the width of the surface and as shown four ribs are provided although this number can be increased or decreased depending upon the dimensions of the funnel surface.

Around the funnel surface is provided a raised flange portion generally indicated at 30. The raised flange portion includes an inner wall 31 which extends upwardly from the funnel surface 20 and is inclined slightly outwardly to define a cup shaped receptacle with the surface 20 into which liquids can be poured. At the top of the inner wall 31 is provided a top wall 32 which is annular and surrounds the inner wall and the funnel surface. The top wall 32 lies in the horizontal plane parallel to the top of the drum and hence the height of the inner wall 31 varies from a minimum at the position 21 on the funnel surface to a maximum at the position 22 on the funnel surface.

Outside the top wall 30 is provided an outer wall 33 which is inclined outwardly and downwardly and surrounds the top wall. The outer wall is thus frusto conical and extends from the top wall at the bead 14. From the outermost edge of the outer wall 33 is provided a skirt 34 which depends vertically downwardly so as to surround the peripheral wall 13 of the drum. At the bottom of the flange 34 is provided a plurality of screw fasteners 35, 36 and 37 at spaced positions around the periphery of the flange 30. Each of these screw fasteners comprises a coupling plate 38 and a screw 39 which passes through holes in the coupling plate and a cooperating hole in the flange. The screw includes the screw head 40 on an outer face of the coupling plate and a screw body passing through the holes into engagement with the outer surface of the drum so as to pinch the drum. The length of the screw can be varied to accommodate different diameters of drum.

The raised flange 30 is shaped with a plurality of indented recesses 50 at spaced positions around the periphery of the flange. Each recess 50 is molded into the flange and defines a bottom wall 51 which commences at the junction between the skirt 34 and the outer wall 33 and extends horizontally inwardly therefrom. The recess further includes a back wall 52 which commences at a position approximately half way across the top wall 32 and extends vertically downwardly therefrom to intersect the bottom wall 51. The recess further includes two side walls 53 and 54. The side walls of each recess 50 are parallel and extend generally radially of an axis A longitudinal of the drum. The recesses 50 are arranged primarily at 90° spacing around the flange. However two additional recesses are arranged as indicated at 50A and 50B on opposed sides of the discharge opening 23 and spaced by an angle of the order of 30° from that one of the recesses indicated at 50C which is aligned with the discharge outlet 23.

The recesses 50 provide two functions. In the first function they provide a stiffening effect for the flange and particularly the top and outer wall thereof. Secondly the recesses provide the bottom wall 51 which lies horizontal and that bottom wall 51 lies in a common plane with the other bottom walls 51 of the recesses 50 so as to define a horizontal plane which can sit on the top surface of the bead 14 that is in contact with the end of the drum. The horizontal plane of the bottom walls 51 is substantially aligned with the bottom of the funnel surface as indicated at 22.

The funnel body is thus mounted on the drum by placing of the bottom walls 51 at the spaced positions around the drum on the end of the drum. In this position the flange 30 extends along the surface 13 of the drum for attachment of the screw fasteners 35, 36, 37. The funnel is thus firmly attached to the end of the drum and can remain in place even should the drum be knocked over or if the drum is moved or the funnel knocked.

The two additional recesses 50A and 50B are arranged adjacent the discharge opening 23 so as to provide additional support for the top wall 32 adjacent the discharge opening 23. Thus a user can place a pail or other container onto the top wall 32 of the flange at the discharge opening 23 and can apply weight therefrom onto the top wall during pouring from the pail into the cup shaped funnel.

The lid of the funnel is generally indicated at 60 and comprises a domed central section 61 and a peripherally extending portion 62 for engaging onto the outside of the flange 30 of the funnel. The domed centre section 61 includes a frusto conical wall 63 and a flat top wall 64 thus forming a space underneath the top wall 64 and above the funnel surface 20 in which a filter or other body 28 can be received for draining while covered by the lid 60.

At the base of the frusto conical wall 63 is provided a horizontal annular wall 65 which is arranged to sit on the top wall 32. The dimensions of the annular 65 and the top wall 32 are substantially coextensive as best shown in FIG. 6. Around the outside edge of the annular wall 65 is provided a downwardly extending outer wall 66 which follows the shape of the outer wall 33 of the flange in a friction fit so that there is line contact therebetween substantially along the full length of the outer wall 66 as best shown in FIG. 6, However in order to fasten the lid to the funnel, there is provided a plurality of recesses 70 formed in the lid at spaced positions therearound. The spacing of the recesses 70 is arranged to be identical to the spacing of the recesses 50 so that each of the recesses 70 cooperates with and is received within one of the recesses 50. The recess 70 thus includes a rear wall 71 extending vertically downwardly from a position across the annular wall 65 and two side walls 72 and 73 which again are parallel and are spaced so that they lie in contact with the side walls 53 and 54 of the recess 50. Each recess 70 is therefore a friction fit within the respective recess 50 to hold the lid in place while allowing it to be readily grasped and removed simply by pulling against the friction fit.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A funnel for mounting on an end of a cylindrical drum for directing fluids into an opening at the end of the drum comprising a molded funnel body defining an upper funnel surface, an annular raised flange portion surrounding the upper funnel surface which includes an inner wall extending from the funnel surface upwardly and outwardly, a top wall surrounding the inner wall and an outer wall surrounding the top wall and depending downwardly therefrom and a plurality of separate substantially horizontal wall portions formed by recesses defined in the outer wall, an annular skirt depending downwardly from the raised flange portion, the funnel surface being inclined toward a drain opening adjacent the raised flange portion at one side of the funnel surface, and engagement wall means consisting of the horizontal wall portions arranged at spaced positions around the funnel surface and extending inwardly from the skirt for engaging a horizontal surface at the end of the drum for supporting the funnel body on the end of the drum against downward movement, the skirt depending downwardly of the engagement wall means for surrounding a cylindrical wall surface of the end of the drum and including fastener means for extending inwardly of the skirt to engage the drum at the cylindrical wall surface whereby the skirt, the fastener means and the engagement wall means hold the funnel body fastened to the end of the drum.

2. The funnel according to claim 1 including a plurality of ribs on the funnel surface for supporting a body to be drained on the ribs spaced upwardly of the funnel surface to allow draining of the body to be drained.

3. The funnel according to claim 2 wherein the ribs are parallel and generally triangular in cross section so as to form an upper apex which is horizontal with the cross section of the rib gradually increasing in dimensions from the first end partly across the funnel surface to a second end partly across the funnel surface.

4. The funnel according to claim 1 wherein the fastener means comprises a plurality of screw fasteners having a screw head outside the skirt and a screw body passing through the skirt for engagement with the drum.

5. The funnel according to claim 1 wherein the engagement wall means comprises a horizontal surface arranged to lie on an outer edge of the end of the drum adjacent the skirt.

6. The funnel according to claim 1 wherein each recess has a substantially vertical back wall, a substantially horizontal bottom wall defining the horizontal wall portion and two parallel side walls extending generally radially relative to an axis substantially centrally of and substantially at right angles to the funnel surface.

7. The funnel according to claim 6 wherein the back wall of the recess intersects the top wall of the raised flange portion at a position partway thereacross.

8. The funnel according to claim 1 including a domed lid having a peripheral engagement portion for engaging the raised flange portion of the funnel body and a central domed portion extending upwardly from the peripheral engagement portion and covering the funnel surface leaving a space therebetween for a body to be drained.

9. A The funnel according to claim 8 wherein the peripheral engagement portion engages the outer wall and lies substantially parallel thereto.

10. The funnel according to claim 9 wherein the peripheral engagement portion of the lid includes a plurality of recesses therein for engaging into the recesses in the outer wall.

11. A funnel for mounting on an end of a cylindrical drum for directing fluids into an opening at the end of the drum comprising a molded funnel body defining an upper funnel surface, an annular raised flange portion surrounding the upper funnel surface which includes an inner wall extending from the funnel surface upwardly and outwardly, a top wall surrounding the inner wall and an outer wall surrounding the top wall and depending downwardly therefrom and plurality of separate substantially horizontal wall portions formed by recesses defined in the outer wall, an annular skirt depending downwardly from the raised flange portion, the funnel surface being inclined toward a drain opening adjacent the raised flange portion at one side of the funnel surface, and engagement wall means consisting of the horizontal wall portions arranged at spaced positions around the funnel surface and extending inwardly from the skirt for engaging a horizontal surface at the end of the drum for supporting the funnel body on the end of the drum against downward movement, and a domed lid having a peripheral engagement portion for engaging the raised flange portion of the funnel body and a central domed portion extending upwardly from the peripheral engagement portion and covering the funnel surface leaving a space therebetween for a body to be drained and wherein the peripheral engagement portion engages the outer wall and lies substantially parallel thereto and wherein the peripheral engagement portion of the lid includes a plurality of recesses therein for engaging into the recesses in the outer wall.

12. The funnel according to claim 11 wherein each recess has a substantially vertical back wall, a substantially horizontal bottom wall defining the horizontal wall portion and two parallel side wails extending generally radially relative to an axis substantially centrally of and substantially at right angles to the funnel surface.

* * * * *